United States Patent [19]

Schoeller et al.

[11] Patent Number: 4,884,712

[45] Date of Patent: Dec. 5, 1989

[54] STACKABLE BOTTLE CASE

[76] Inventors: Martin Schoeller; Christoph Schoeller, both of Haus Balaster, CH-7524 Zuoz, Graubunden, Switzerland

[21] Appl. No.: 183,756

[22] PCT Filed: Jul. 14, 1987

[86] PCT No.: PCT/EP87/00382

§ 371 Date: Mar. 14, 1988

§ 102(e) Date: Mar. 14, 1988

[87] PCT Pub. No.: WO88/00558

PCT Pub. Date: Jan. 28, 1988

[51] Int. Cl.[4] ..... B65D 1/24; B65D 1/48

[52] U.S. Cl. ..... 220/21; 206/427; 206/429

[58] Field of Search ..... 220/21; 206/427, 429

[56] References Cited

U.S. PATENT DOCUMENTS

| | | | |
|---|---|---|---|
| 3,353,659 | 11/1967 | Beesley | 220/1 R |
| 3,380,616 | 4/1968 | Schoeller | 220/21 |
| 3,386,607 | 6/1968 | Keene | 220/21 |
| 3,997,074 | 12/1976 | Shead | 220/21 |
| 4,143,764 | 3/1979 | Moss | 206/429 |
| 4,308,966 | 1/1982 | Ettema | 220/21 |
| 4,548,320 | 11/1985 | Box | 220/21 |

FOREIGN PATENT DOCUMENTS

| | | | |
|---|---|---|---|
| 2837910 | 3/1980 | Fed. Rep. of Germany | 206/427 |
| 1534869 | 6/1968 | France | 220/21 |
| 1084191 | 9/1967 | United Kingdom | 220/21 |
| 1130035 | 10/1968 | United Kingdom | 220/21 |

*Primary Examiner*—George E. Lowrance
*Attorney, Agent, or Firm*—Reese Taylor

[57] ABSTRACT

In a stackable bottle case made in particular of plastics material and having compartment divisions for taking up the bottles in the interior of the case, support profiles in the corners of the case interconnect a peripheral upper handle strip and a peripheral lower bottom strip to form a case frame. The support profiles limit between each other, or with support strips disposed at the bottle gaps, open display windows between the bottom strip and the handle strip.

16 Claims, 10 Drawing Sheets

STACKABLE BOTTLE CASE

The present invention relates to a bottle case according to the introductory part of claim 1.

Different constructions of bottle cases are known. What they have in common, however, is that the side walls are designed to have not only a protective function for the bottles during transport and handle openings of various sizes but also sufficient width and height to bear large labels indicating the origin and/or the contents of the bottles contained in the case.

Manufacturers of beverages rarely offer just one product nowadays, but rather a number of different products which are filled in bottles of the same size and also supplied in cases of the same size. This makes it necessary to provide the conventional bottle cases with corresponding product-related information in the form of labels and the like, and to use appropriate sorting machines for packaging to ensure that the bottles leaving the bottling unit are packed in the bottle cases provided with the appropriate labels or printing. This product-related marking of the bottle cases, however, involves not only extra expenses for bottling and packaging but also the disadvantage that when the labels are worn off or damaged the bottles contained in the cases cannot be immediately recognized by the consumer from the outside; he must first remove a bottle from the case or look into the case from the top. This is unfavorable in particular for marketing reasons. There have been attempts to build cases with large openings as display windows in the side walls, but these constructions have not gained acceptance due to insufficient stability of the case frame and thus poor stackability.

The invention is thus based on the problem of providing a bottle case having a display function, which is sufficiently stable and rigid and allows for good stackability.

This problem is solved according to the invention by the features contained in the characterizing part of claim 1.

The invention is characterized by the fact that the side walls of the case are designed with display windows which are open, in particular open without any interruption, from the bottom strip to the handle strip on the upper edge of the case. This gives the case itself an immediate display function, since the design of the case itself exposes the bottles and thus the labels on both their necks and bodies to the consumer, so that the case allows the bottles alone to show the product-related marking important to the consumer. Further markings are thus actually unnecessary on the bottle case since the bottle itself is completely included in the product-related marking due to this design of the bottle case.

Of course, it should nevertheless be possible to provide the case with labels and printing in the interests of optimal advertising. This can be done on the handle and bottom strips and on the relatively wide corner support profiles, which together form a one-piece rigid case frame. The handle strip, bottom strip and corner support profiles thus frame, in conjunction with support strips, the display window or windows. The invention is advantageously applicable in particular to bottle cases for large-size bottles, the labels on the bottles already being relatively large due to the bottle size.

The compartment divisions inside the case are expediently hidden from the outside by vertical support strips in the area of the side walls of the case, i.e. in the area of the display window and thus on the plane of the side walls of the case. These support strips can extend from the bottom strip only as high as is required for supporting the bottles contained in the case. The free ends of the support strips are then spaced from the upper, handle strip. In this way the support strips cover the compartment divisions from the outside or cover the gaps between the bottles and may furthermore be used advantageously as supporting surfaces for holding the bottles. For this purpose the support strips are expediently disposed at the bottle gaps and cover the bottles only slightly without concealing the labels on their bodies and necks from the outside. Alternatively, the support strips connect the bottom of the case with the handle strip, thereby contributing to the stability of the case frame in combination with the corner support profiles.

The support strips can also contribute expediently to the rigidity of the case if they are attached to the overall frame due to the one-piece connection with the compartment divisions and the one-piece connection of the compartment divisions with the grid bottom.

It is further advantageous for the stability or rigidity of the case if the corner support profiles and the support strips are designed as self-contained hollow sections. The danger of dirt accumulation is kept low by giving the hollow sections a smooth-walled design according to a further embodiment of the invention.

According to a further embodiment expedient in terms of stability, the corner support profiles are embodied by beaded walls, the beads advantageously extending vertically over substantially the entire length of the support profiles. To increase rigidity, the support strips may be embodied by walls formed in the manner of a corrugated sheet, in particular a sheet with trapezoidal corrugations. The latter means in this connection that the loops or troughs of the corrugations are of trapezoidal shape. This embodiment is characterized by stability but still allows for fast, easy and thorough cleaning of soiled cases, because beaded or (trapezoidally) corrugated shapes, unlike ribbed cases, do not lead to the formation of pockets with an angle equal to or smaller than 90 degrees in which dirt accumulates and can only be removed with difficulty even by intensive cleaning.

In connection with the design of the corner support profiles and the support strips as hollow sections, it is also expedient in terms of stability to draw them as far as possible into the interior of the case, which involves the further advantage that the inner side walls of these profiles can be used at the same time as supporting surfaces for the bottles contained in the case.

The display windows are expediently designed in the manner of loop-holes. This is obtained in a simple way by disposing the opposite side walls between adjacent corner support profiles and support strips at an angle to one another in such a way as to form loophole-like openings between the profiles and the strips, which belong to the display window and virtually draw the consumer's eye to the labels on the bottles, which are visible from the outside. This design thus also contributes to the display function of the case.

It is also advantageous for a stable construction to give the bottom and handle strips an inverse U-shaped cross-section, whereby according to an expedient development the bottom and handle strips may be strengthened by webs or ribs bridging the legs of the U. The open U shape of the handle strip also makes it possible to insert from below an intermediate piece which, due to its rounded bottom, makes it easier to carry the bottle case.

It is also especially advantageous to provide the handle strip on both the upper and lower edges with a rib running around it which is expediently rounded on the outside. These ribs limit between each other a labelling field protected from the outside, whose recessed position largely prevents the labels from slipping during labelling.

It is expedient for stacking if the bottom strip running around the bottom grid of the case in one piece therewith is raised above the bottom grid and offset outwardly together with the handle strip.

The invention achieves maximum utilization of the side walls of the case as display windows, since the stability of the case is obtained by the composite structure of the corner support profiles with the upper, handle strip and the lower, bottom strip in particular in conjunction with vertical support strips. The display window areas can thus be very large and the size is limited solely by the necessity of preventing the bottles contained in the case from falling out by support strips, transverse strips and the like. However, the employability of the case also depends on the cooperation of the support strips, which are disposed at the gaps between the bottles and contribute advantageously to stable stacking of the cases in so far as, in the case of offset stacking, the load of the uppermost cases is introduced or absorbed via the support strips into the side walls of the cases stacked below. For this purpose it is expedient to provide the bottom of the case with so-called stacking grooves which are located below the support strips and into which the side walls of the lower case fit when a stack is formed. The design of the case as a rigid frame consisting of the corner support profiles, handle strip, bottom strip and support strips allows for a very smooth-walled construction of a case to be obtained, which has a relatively low degree of dirt accumulation and can in particular be cleaned easily and quickly. The case offers the additional advantage that, in spite of the maximum utilization of the side walls as display windows, further marking means can be applied to the handle strip, the bottom strip and possibly also to the corner support profiles. Using simple and coordinated measures, the invention thus succeeds in maximizing the display opening while still ensuring sufficient, in particular great, stability of the case, whereby the bottles can be prevented from falling out in spite of the large display openings, and in particular good stackability even under load is also guaranteed. Due to the stability of the case no ribbing is necessary; the case can instead be given substantially smooth walls with high material economy so that the case can also be cleaned easily and simply.

In the following, exemplary embodiments of the invention shall be described with reference to the drawing, in which:

FIG. 1 shows a side view of a narrow side of an embodiment of the inventive bottle case containing bottles, FIG. 2 shows a top view of a similar bottle case as in FIG. 1, in partial cross-section, FIG. 3 shows a side view of the narrow side of the case, FIG. 4 shows a side view of the broad side of the case, FIG. 5 shows a side view of a further embodiment of a bottle case, FIG. 6 shows a side view of the narrow side of the case of FIG. 5, FIG. 7 shows a top view of the case of FIG. 5, in partial cross-section.

Figure 1:
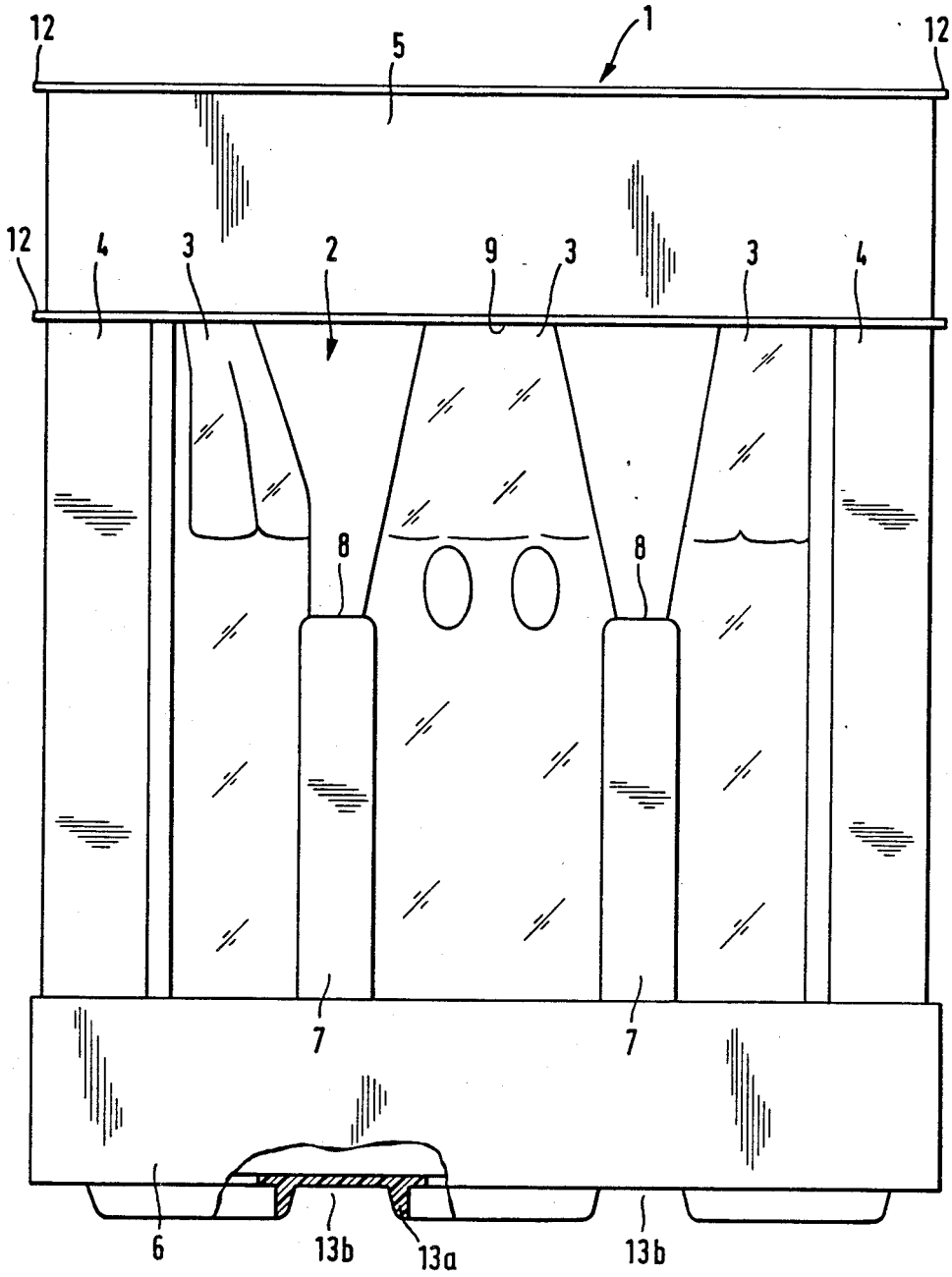

Bottle case 1 shown in the drawing has in each of its four side walls one display window 2 open without interruption, which serves to display bottles 3 contained in the bottle case, as indicated best by FIG. 1. One can also see here that display window 2 is bordered laterally by support profiles 4 forming the corners of bottle case 1, on the top by a transverse handle strip 5 on the upper edge of the case and on the bottom by a bottom strip 6 on the lower edge of the case. Handle strip 5 and bottom strip 6 are designed to run around the four side walls of case 1 and are interconnected only at the four corners by support profiles 4. Except for corner support profiles 4 and the handle and bottom strips, the remaining area of the side wall can thus be utilized for the display function.

In the embodiment shown, separate support strips 7 are provided in the area of the open side walls both for rigidity but in particular also to hold bottles 3 contained in case 1 and to protect them from falling out, said strips being disposed, as shown in FIG. 1, in alignment with or at the bottle gaps and, due to their narrow design, covering the bottles contained in case 1 only to a small degree, the degree of covering being determined solely by the supporting function for the bottles in order to give the bottles a firm hold and prevent them from falling out through the display opening. These support strips 7, two of which are formed on each side wall in the embodiment shown, extend vertically and over only part of the height of the case, so that free ends 8 of the support strips are spaced from lower edge 9 of handle strip 5 at a distance important for the display function. The height of support strips 7 depends substantially on the supporting function for holding bottles 3 contained in case 1 and is about half the bottle height in the embodiment shown.

As FIG. 1 shows quite clearly, bottles 3 contained in case 1 are freely visible to a great extent from the outside due to large display window 2, so that the labels on the necks and bodies of the bottles can be seen at once by the consumer. These areas essential for determining the bottle contents are hidden neither by the case frame nor by support strips 7, which also serve as shields for the compartment walls indispensable within the case so as to hide them from the outside. Handle strip 5 forming the upper edge of the case is high enough to allow the bottle case to be grasped comfortably for transportation purposes. The height of bottom strip 6 is such that essentially only the bottoms of the bottles are hidden from the outside but not their bodies. The handle and bottom strips are in practice only a few centimeters high, the selected height also depending on whether the beverage producer would like to provide additional information and advertising on the bottom and handle strips.

Legs 10 and 11 of U-shaped handle strip 5 may be bridged or connected on the inside of the handle strip by webs or ribs, which contribute to the rigidity of the case frame but are not visible from the outside. These webs or ribs are not shown in the drawing. The cross-sectional design of handle strip 5 offers the further advantage that handle strips can be pressed or snapped in from the bottom, which can be provided at places the consumer chooses so as to make the bottle cases easier to carry.

On the outside of handle strip 5, outwardly protruding ribs 12 are molded onto the upper and lower edges, in the embodiment shown, so as to limit between each other a labelling field which is thereby recessed. These ribs 12 are advantageous in that the label does not slip off during labelling and, once it is provided on handle strip 5, it is also protected from being damaged during transport and stacking of the case. Ribs 12, which are expediently rounded on the outside, also contribute to the rigidity of the frame. For this purpose the ribs are expediently designed to run around the handle strip.

Figure 4:
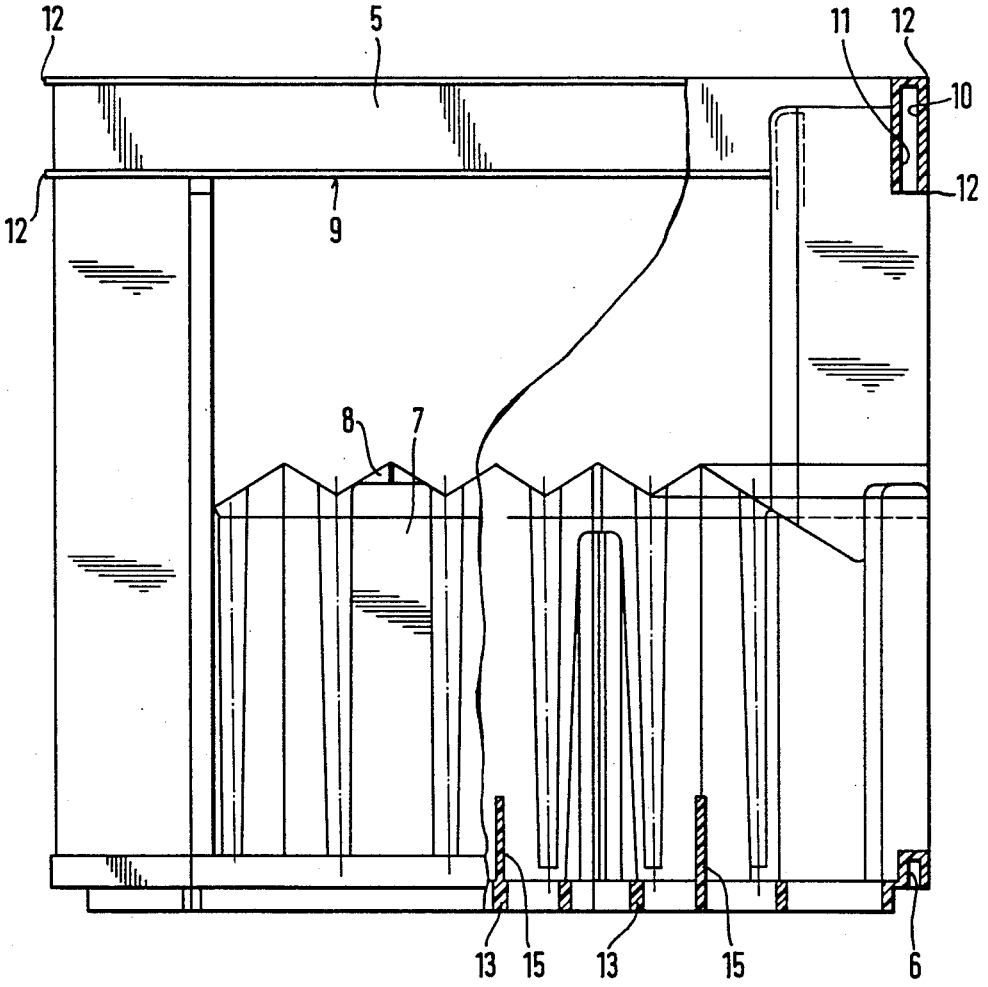

According to FIG. 4, bottom strip 6 is raised above the bottom grid referred to as 13, and is offset outwardly. Handle strip 5 connected in one piece with bottom strip 6 via support profiles 4 disposed at the corners is seated substantially congruently above bottom strip 5. This allows for bottom grid 13 to fit from the top into handle strip 5 in the stack, thereby allowing stacked cases to overlap in a way essential for lateral support in the stack (in the case of direct stacking). If required, however, a different bottom construction may also be selected. But this design ensures that the forces are absorbed substantially via the bottom and handle strips and thus via stably designed corner support profiles 4. Also advantageous for stacking, in particular offset stacking, is the design of the bottom grid shown schematically in FIG. 1. Here, the bottom of the case is provided below support strips 7 with stacking grooves **13*b* limited by vertically extending webs 13*a*** of the bottom grid, said grooves extending parallel to the side walls of the case over the width and length of the case. When stacked cases are laterally offset, the upper portions of the side walls of the lower case engage these grooves, so that the forces are carried in the stack via the support strips directly onto the side walls of the lower case or cases.

Figure 2:
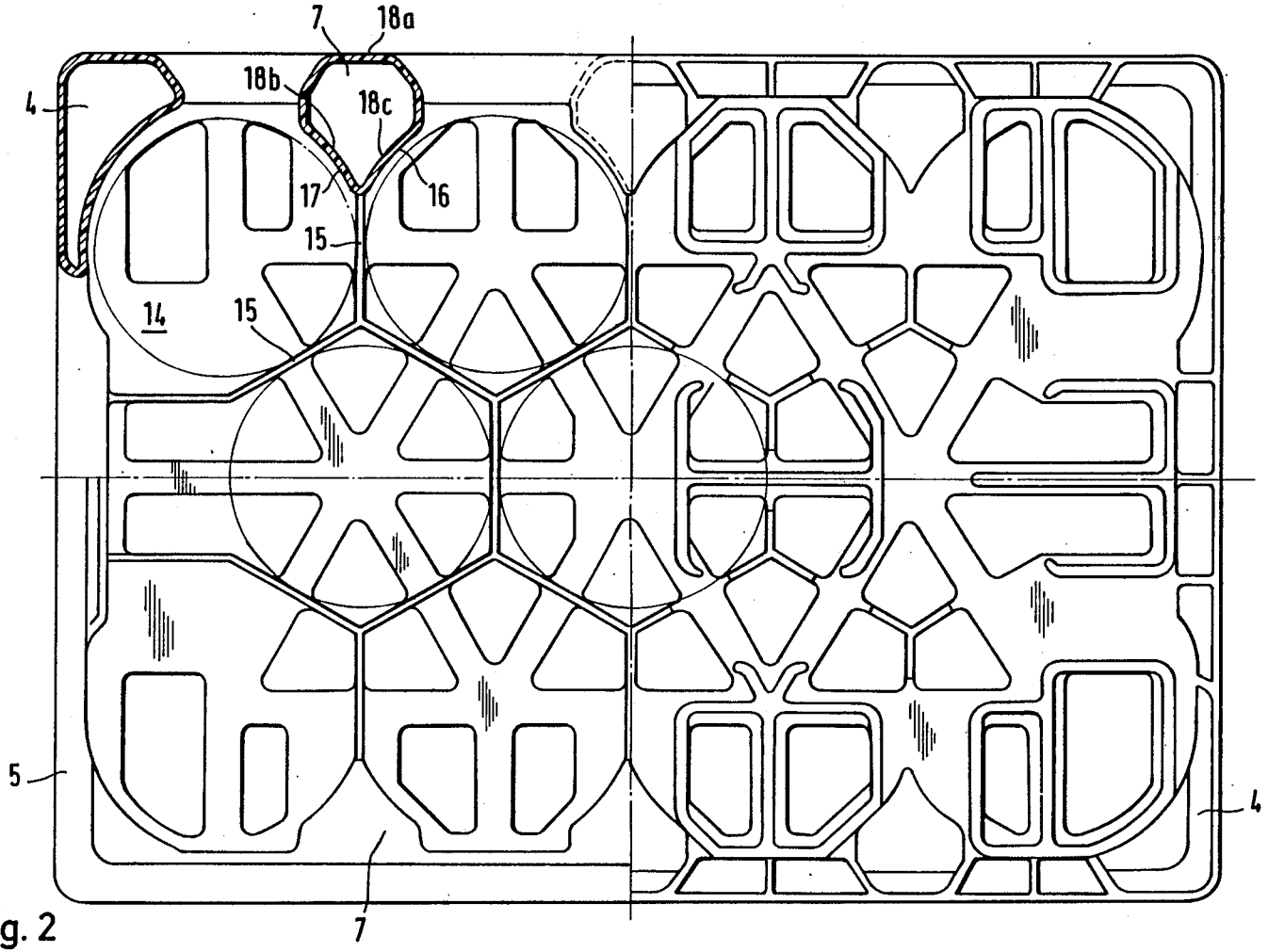
Figure 3:
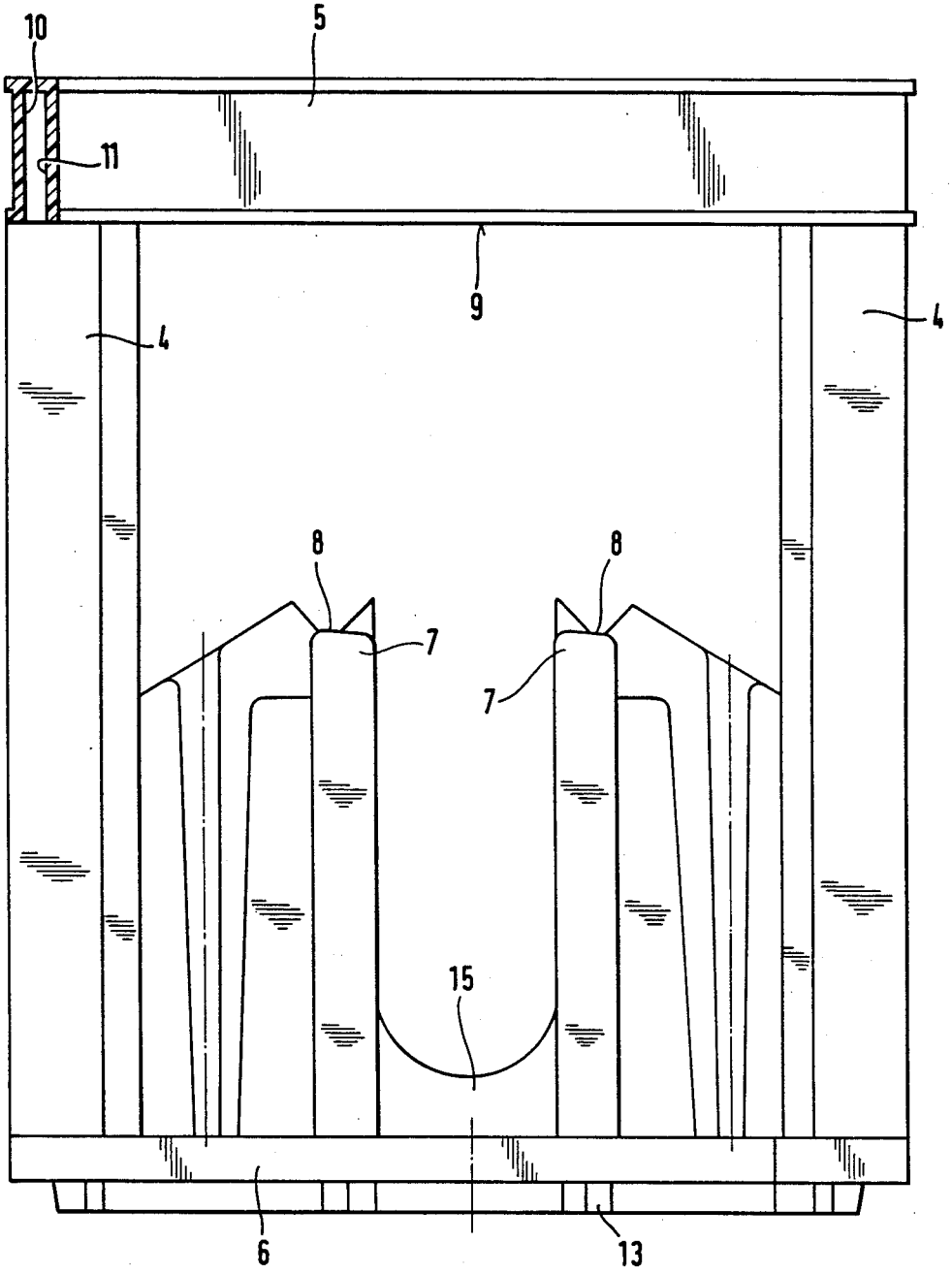

As already mentioned above and quite clearly indicated in particular in FIG. 2, support strips 7 can form part of the compartment divisions referred to as 14, which are composed of compartment walls 15 interconnected in one piece at the nodal points. Like support strips 7, compartment walls 15 are expediently formed in one piece with the bottom grid. Support strips 7 molded on bottom strip 6 are thus also connected with the case frame via compartment walls 15 via the bottom grid to form a stable and rigid construction. As shown by FIG. 3, some of the compartment walls may be limited in their height, in particular when the distances between adjacent bottles are small due to the predetermined arrangement of the bottles in the compartments. In this case these compartment walls 15, at least in some portions, substantially extend only over the bottom portions of the bottles and not high enough to cover their bodies.

In the embodiment of FIGS. 1 to 5, support strips 7, like corner support profiles 4, are designed as self-contained hollow sections, giving rise to smooth outer walls which reduce the danger of dirt accumulation and facilitate cleaning. At the same time, however, the hollow section design contributes to the rigidity of the case frame. Further, both corner support profiles 4 and support strips 7 are drawn inwardly far enough for the inner side walls of the support profiles and support strips to simultaneously form supporting surfaces, at 16 and 17 in FIG. 2, for the bottles contained in the case.

As further shown quite clearly in FIG. 2, the opposite side surfaces of adjacent corner support profiles 4 and support strips 7 are at an angle to each another, converging from the outside to the inside, in such a way that these profiles form between each other loophole-like display openings belonging to the display windows, which direct the consumer's eye to the bottles and thus to the labelling.

The cross-sectional shape of support strips 7 in the area of the broad side of the case is substantially triangular, the apex of the triangle being located on the inside in the example shown. Side surfaces **18*b* and 18*c* serve as supporting surfaces and thus as part of the compartment divisions for holding the bottles. Side surface 18*a* forms, together with the outer surfaces of the handle and bottom strips and support profiles 4, the outer side wall of the case, the side surfaces of these parts expediently being substantially flush with each other. According to the view in FIG. 2, support strips 7 on the narrow side of the case are modified in so far as they have half the cross-sectional shape of the support strip on the broad side of the case, since with the bottle arrangement of FIG. 2** these support strips must only support or secure one bottle.

Corner support profiles 4 are also each designed as hollow sections and, as shown in FIG. 2, as relatively wide hollow sections extending far into the interior of the case and at the same time contributing to supporting the bottles contained in the compartment. This wide design as a corner profile does justice to the supporting function of the profiles within the case frame and also contributes to improving cooling during the molding process of the case. Due to the smooth construction of the corner profiles the danger of dirt accumulation is greatly reduced. Corner support profiles 4 can also be used for gluing or otherwise applying labels and advertising information. The corner profiles connect the peripheral handle and bottom strips to form a stable frame which is in particular also rigid enough to take up large-size bottles. As explained above, the handle and bottom strips are designed as narrow bands. The distance between the handle and bottom strips is such that in particular the bodies and necks of the bottles, which are chiefly used for labelling, are exposed for the display function when they are contained in the case.

Figure 5:
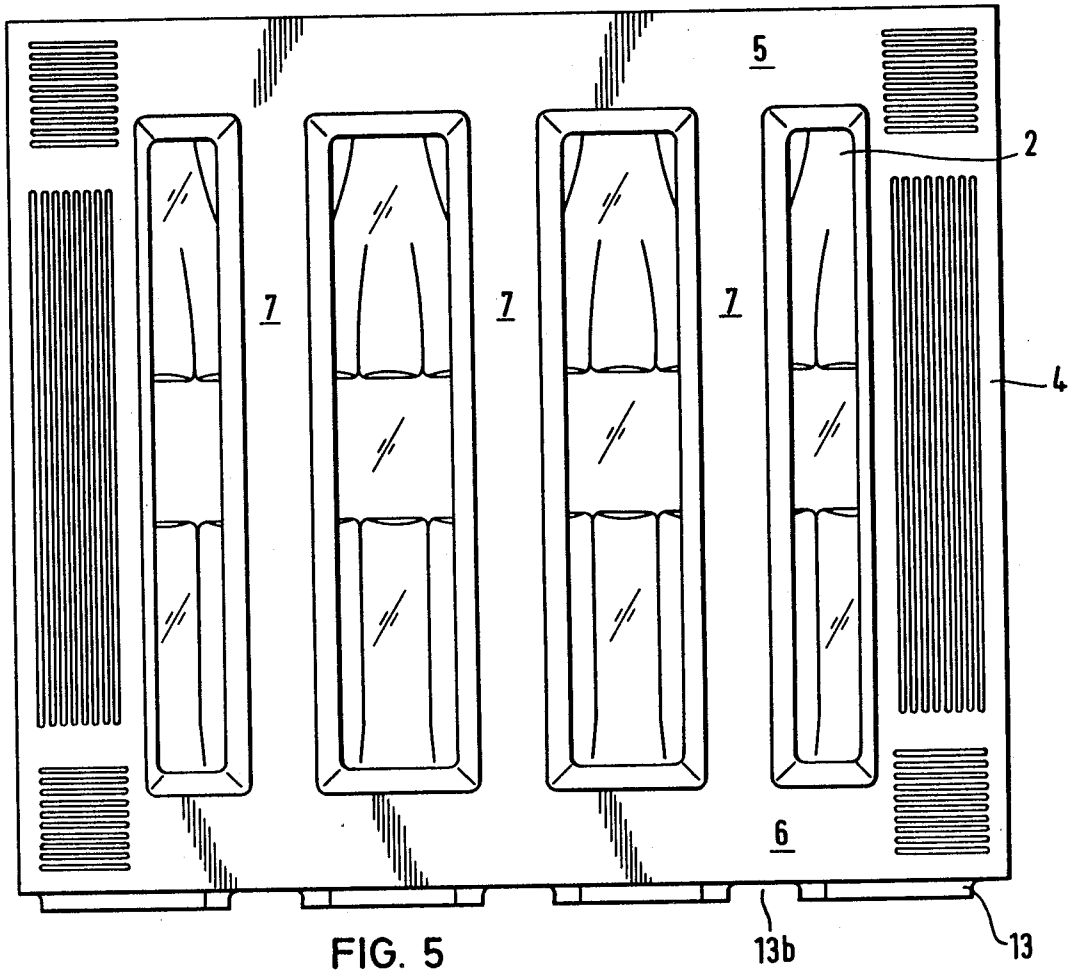
Figure 6:
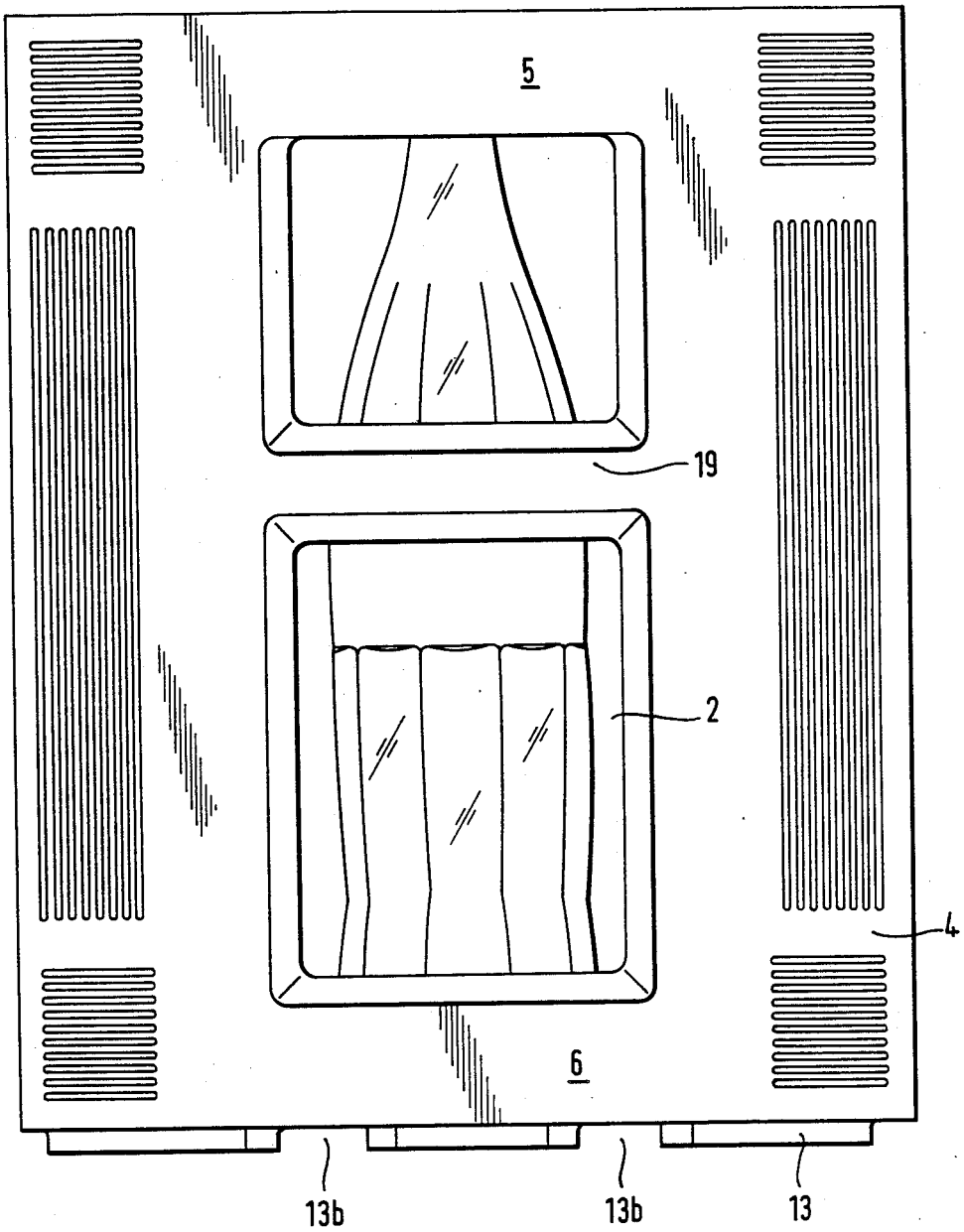
Figure 7:
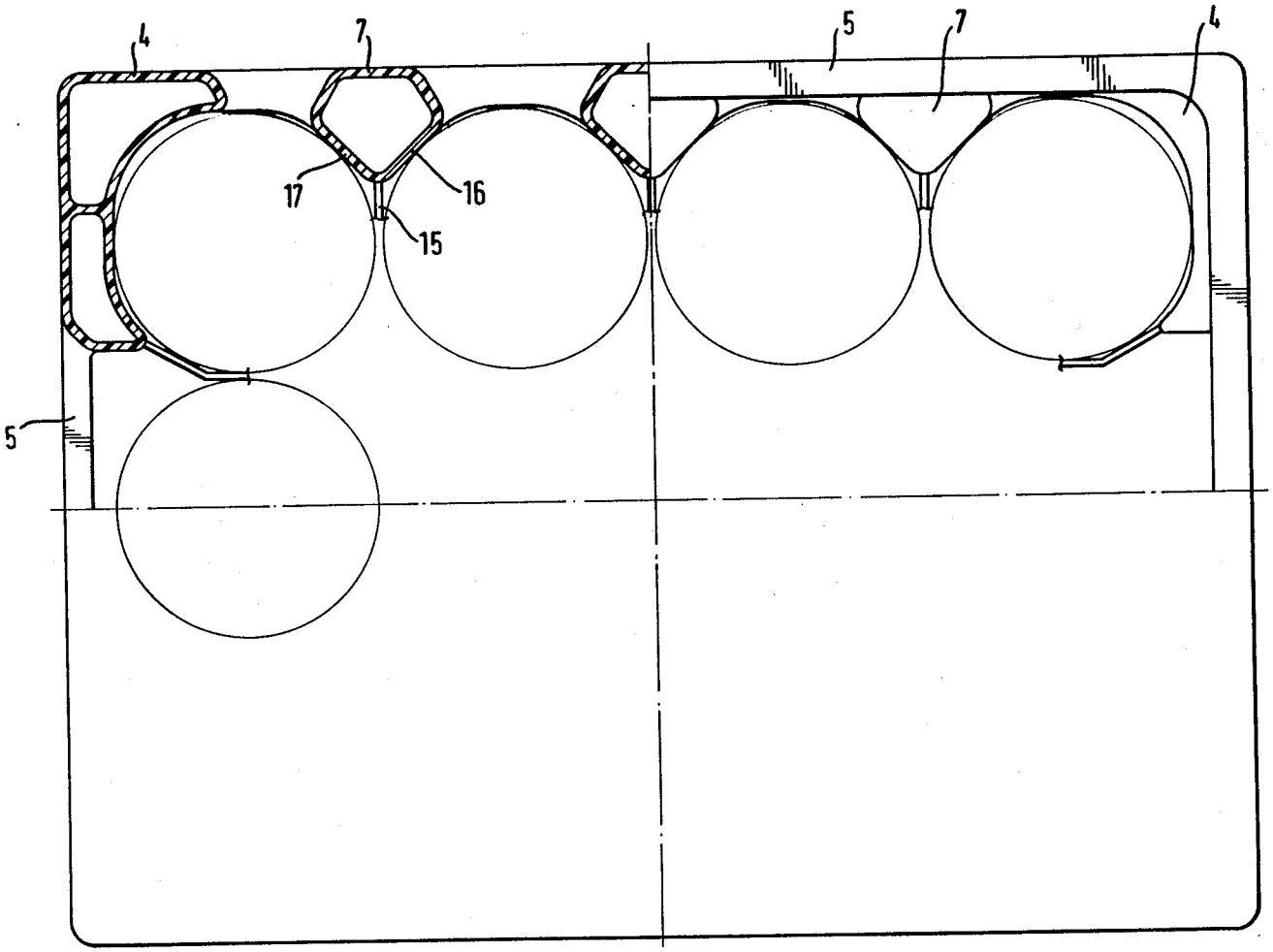

FIGS. 5, 6 and 7 show a further embodiment of a bottle case which differs from the above-described embodiment in particular by support strips 7 which extend without interruption between bottom strip 6 and handle strip 5. In the embodiment shown, three uninterrupted support strips 7 are provided on the broad side which, in conjunction with the two corner support profiles 4, limit altogether four display windows running without interruption from the top to the bottom, which are advantageously designed in the manner of loopholes and allow a view from the outside of substantially the entire bottle disposed inside the case before the side wall. On the bottom of the case one can see grooves or depressions referred to as **13*b* which are expedient for offset stackability and carrying the forces via support strips 7** into the lower case.

FIG. 6 shows the narrow side of the case with substantially only one display window, a transverse strip referred to as 19 being provided to subdivide the display window and allow for further marking means to be applied. FIG. 6 also indicates stacking grooves 13*b* provided on the bottom of the case.

FIG. 7 shows a cross-section of the case from the top to illustrate the hollow section design of the corner profiles and support strips. This cross-section also shows that the supporting surfaces of these corner profiles and the support strips conform with the shape of the bottles to be taken up. Thus, the corner profiles and support strips provided to increase rigidity also secure the bottles contained the case very well against wobbling and falling out.

Figure 8:
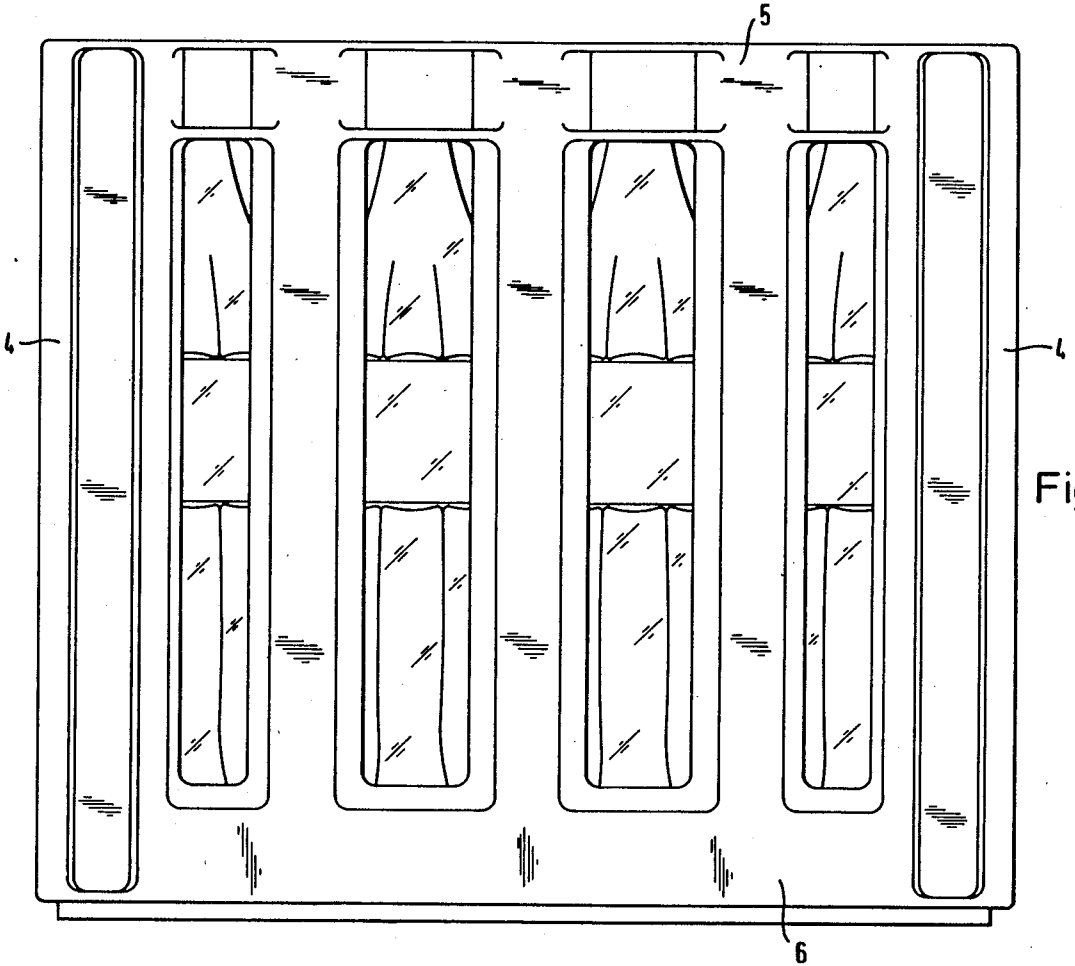
FIG. 8 shows a view of the longitudinal side of a further embodiment.
Figure 9:
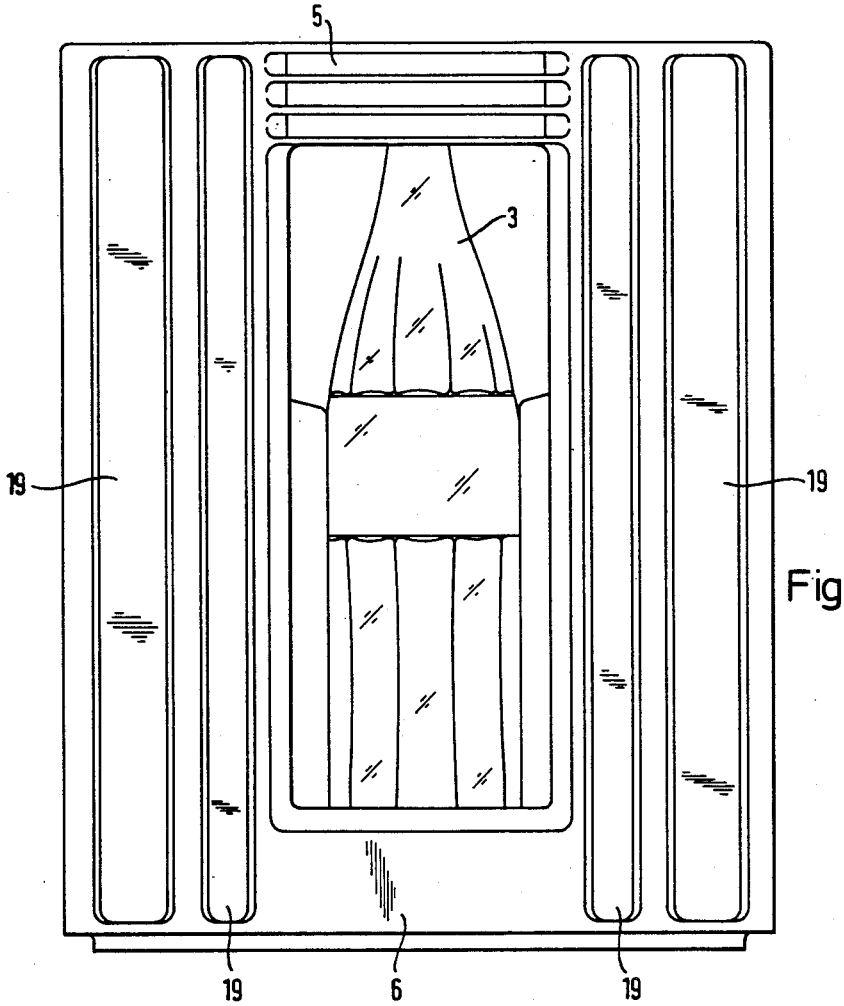
FIG. 9 shows a view of the narrow side of the case of FIG. 8.
Figure 10:
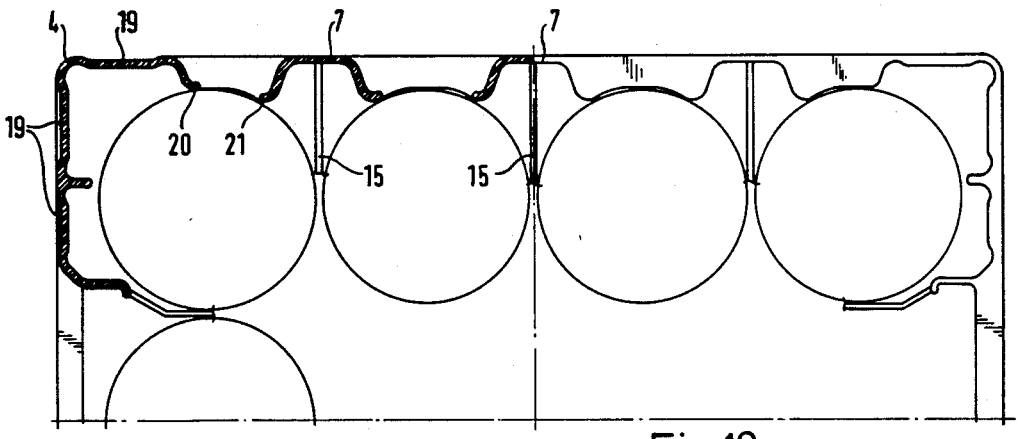
FIG. 10 shows a cross-sectional view of one half of the case shown in FIG. 8, the section extending perpendicular to the plane of FIG. 8.

FIGS. 8 to 10 describe a further embodiment of a case having on each longitudinal side four display windows as in FIG. 8, and on each narrow side one display window as in FIG. 9, the display window or windows extending without interruption between bottom strip 6 and handle strip 5. The special feature of this embodiment is that corner support profiles 4 are strengthened by beads 19 extending vertically. As indicated by Figs. 8 and 9, these beads 19 extend without interruption between the upper and lower edges of the case. The cross-sectional shape of these beads 19 can be seen best in FIG. 10. Support strips 7 of the case have trapezoidal corrugations, as also seen best in FIG. 10. FIG. 10 also shows the connection of support strips 7 to a compartment wall 15 of compartment divisions 14. That support strips 7 have trapezoidal corrugations means in accordance with FIG. 10 that each support strip 7 is formed in a saddle-like shape by a wall of trapezoidal cross-secton, although the base of the trapezoid is lacking. This design of support strips 7 in conjunction with the beaded design of corner support profiles 4 results in a very stable construction of the case. To hold the bottles contained in the case, vertical edges 20 and 21 of corner support profiles 4 and support strips 7 are drawn inwardly so that they limit corresponding contact surfaces for the bottles to be taken up.

Figure 11:
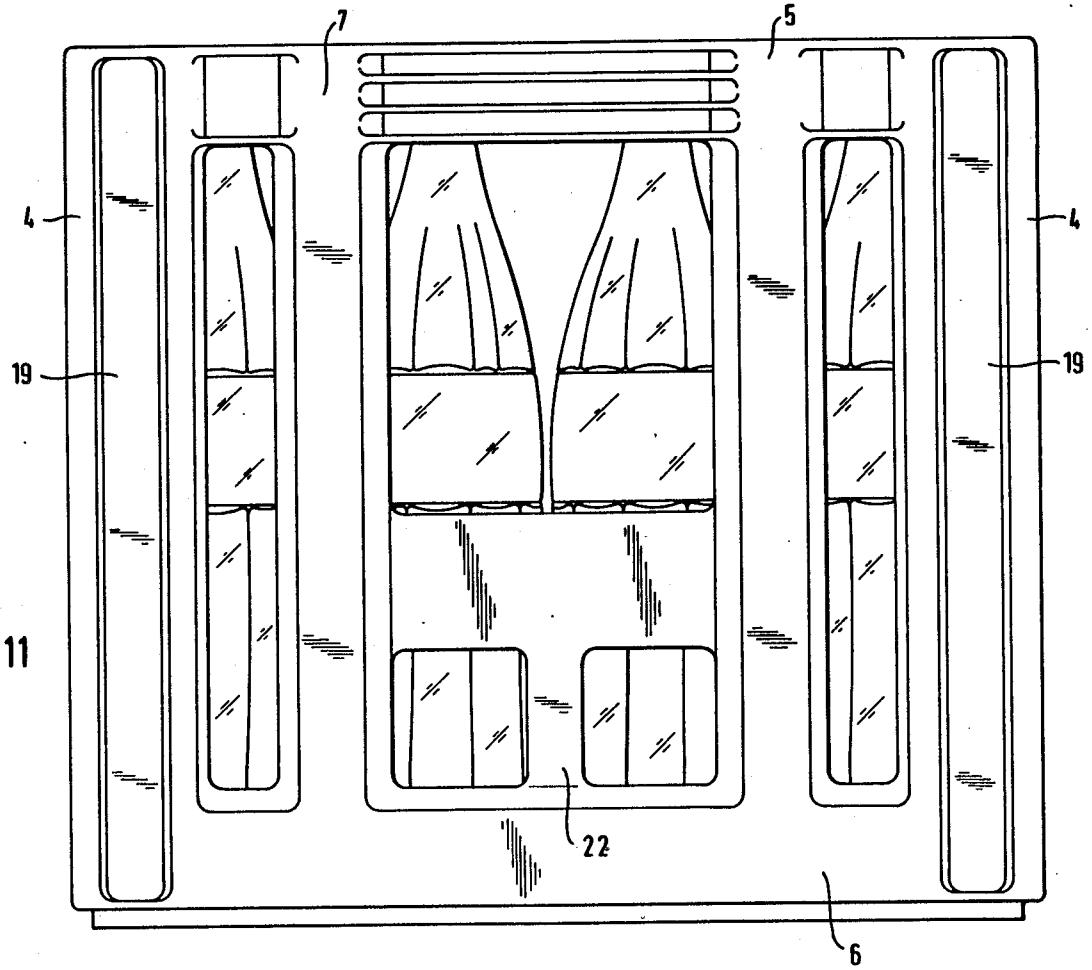
FIG. 11 shows a view of the longitudinal side of a further case.

FIG. 11 shows a further embodiment of a case with two display windows extending without interruption from the top to the bottom, and a larger central display window which is divided into three display openings by a T-shaped strip 22. In this embodiment as well, corner support profiles 4 are provided with beads 19. Support strips 7 have (trapezoidal) corrugations.

We claim:

1. A plastic, stackable bottle case having compartment divisions for holding and separating bottles, comprising:

a case frame in the shape of a box with four side walls, a bottom surface and an open top;

at least one support profile at the intersections of each said side wall with another said side wall;

a peripheral handle strip in juxtaposition with said open top;

a peripheral bottom strip in juxtaposition with said bottom surface;

said support profile interconnecting between said handle strip and said bottom strip;

said support profile, said handle strip and said bottom strip defining the boundary limits of an open area in each of said side walls extending from said handle strip to said bottom strip;

at least one support strip disposed in said open areas in a position approximately between two of the bottles in at least one of said side walls and extending from said bottom strip toward said handle strip to form at least two display windows extending from said handle strip to said bottom strip;

means permitting stacking engagement between at least two of the cases;

said support profile and said support strips being self-contained, smooth-walled hollow sections drawn laterally into the interior of the case and shaped so as to conform to the contours of the bottles and form support surfaces therefor;

wherein, said open area permits the user to view a major portion of the contents of the case without removing the bottles or otherwise opening the case; and the outer surfaces of said handle strip, said bottom strip, said support profile and said support strip lying in substantially the same plane.

2. A bottle case as in claim 1 wherein said support strip protrudes from said bottom strip into said plane of said side wall and terminates at some distance before said handle strip.

3. A bottle case as in claim 1 wherein said support strip extends approximately from half the height of the case to two thirds the height of the case.

4. A bottle case as in claim 1 wherein said support strip interconnects and is contiguous with both said handle strip and said bottom strip.

5. A bottle case as in claim 1 wherein said support profile is formed by walls having vertical beads extending substantially over the entire length of said support profiles and said support strips are formed by walls resembling trapezoidal corrugations.

6. A bottle case as in claim 5 wherein said support strips are formed by walls resembling corrugated sheets.

7. A bottle case as in claim 1 wherein said support strips are integrally formed with the compartment divisions.

8. A bottle case as in claim 1 wherein said means to permit stacking engagement includes stacking grooves in said bottom surface in a position below said support strips, said stacking grooves being engagable with the upper edges of said side walls of a case stacked below.

9. A bottle case as in claim 8 wherein said stacking grooves extend parallel to the side walls of the case and over the width and length of the case.

10. A bottle case as in claim 1 wherein said support strips have a triangular cross-section.

11. A bottle case as in claim 10 wherein the walls of said triangular shaped support strip adjacent to the interior of the case form supporting surfaces for the bottles.

12. A bottle case as in claim as in claim 1 wherein said bottom strip has an inverse U-shaped cross section.

13. A bottle case as in claim as in claim 1 wherein said handle strip has an inverse U-shaped cross section.

14. A bottle case as in claim as in either claim 12 or 13 wherein said U-shaped cross section has laterally spaced connecting webs bridging the legs of the U.

15. A bottle case as in claim as in claim 1 wherein said handle strip has ribs running around its upper and lower periphery and protruding outwardly away from the interior of the case.

16. A bottle case as in claim as in claim 1 wherein said bottom strip and said handle strip are offset outwardly beyond the dimensions of said bottom surface.

* * * * *